US010349719B2

(12) United States Patent
Provost et al.

(10) Patent No.: US 10,349,719 B2
(45) **Date of Patent: *Jul. 16, 2019**

(54) SHAVING RAZOR TRAY

(71) Applicant: SHAVELOGIC, INC., Dallas, TX (US)

(72) Inventors: Craig A. Provost, Boston, MA (US); John W. Griffin, Moultonborough, NH (US); William E. Tucker, Attleboro, MA (US)

(73) Assignee: ShaveLogic, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/115,157

(22) Filed: Aug. 28, 2018

(65) Prior Publication Data

US 2018/0360187 A1 Dec. 20, 2018

Related U.S. Application Data

(63) Continuation of application No. 15/510,410, filed as application No. PCT/US2015/044996 on Aug. 13, 2015, now Pat. No. 10,085,539.

(60) Provisional application No. 62/049,542, filed on Sep. 12, 2014.

(51) Int. Cl.

| | |
|---|---|
| ***A45D 27/29*** | (2006.01) |
| ***A45D 27/00*** | (2006.01) |
| ***B26B 21/40*** | (2006.01) |
| ***A45D 27/22*** | (2006.01) |
| ***B26B 21/22*** | (2006.01) |

(52) U.S. Cl.

CPC ..... *A45D 27/29* (2013.01); *A45D 27/00* (2013.01); *A45D 27/225* (2013.01); *B26B 21/225* (2013.01); *B26B 21/40* (2013.01)

(58) Field of Classification Search

CPC ..... A45D 27/225; A45D 27/24; A45D 27/29; A61B 17/3215; A61B 83/10

USPC ..... 206/354

See application file for complete search history.

(56) References Cited

U.S. PATENT DOCUMENTS

| | | | | |
|---|---|---|---|---|
| 3,754,326 | A | 8/1973 | Glaberson | |
| 7,040,024 | B2 * | 5/2006 | Lukan | A45D 27/29 211/88.01 |
| D533,380 | S | 12/2006 | Dansreau et al. | |
| D533,466 | S | 12/2006 | Wonderley | |
| 7,159,324 | B2 | 1/2007 | Worrick, III | |
| D614,507 | S | 4/2010 | Lukan | |
| D630,527 | S | 1/2011 | Wonderley | |
| D634,649 | S | 3/2011 | Wonderley | |
| 2007/0007155 | A1 | 1/2007 | Foster | |
| 2007/0220754 | A1 | 9/2007 | Barbaro et al. | |

(Continued)

FOREIGN PATENT DOCUMENTS

| | | |
|---|---|---|
| WO | 199836658 | 8/1998 |

OTHER PUBLICATIONS

Search Report and Written Opinion—Corresponding PCT Application No. PCT/US15/44996, dated Nov. 13, 2015, 8 pages.

(Continued)

*Primary Examiner* — King M Chu

(74) *Attorney, Agent, or Firm* — Leber IP Law; Celia H. Leber

(57) ABSTRACT

A tray is disclosed for securely holding a shaving razor and a shaving cartridge magazine when not in use.

10 Claims, 6 Drawing Sheets

(56) References Cited

U.S. PATENT DOCUMENTS

2009/0321292 A1 12/2009 Prudden, Jr. et al.

OTHER PUBLICATIONS

Schick Quattro Razor Along 2 Cartridges, Datasheet [online], US Razor, 2013 [retrieved on Oct. 12, 2015]. Retrieved from the Internet: http://web.archive.org/web/20130722234913/https://www.usrazor.com/index.php?route=product/product&path-69_71&product_id=116.

Gillette Fusion ProGlide, Datasheet [online] Proctor and Gamble, 2012 [retrieved on Oct. 12, 2015], Retrieved from the Internet: http://web.archive.org/web/20120506220314/http://www.pg.com/en_US/downloads/innovation/factsheet_Proglide.pdf.

* cited by examiner

SHAVING RAZOR TRAY

RELATED APPLICATIONS

This application is a continuation of U.S. application Ser. No. 15/510,410, filed Mar. 10, 2017, which is a National Stage Entry of PCT Application No. PCT/US2015/44996, filed Aug. 13, 2015, which claims the benefit of U.S. Provisional Application No. 62/049,542, filed Sep. 12, 2014. The complete disclosures of these applications are hereby incorporated by reference.

BACKGROUND

Shaving razors are often sold with an accompanying tray that allows the razor to be stored horizontally on a counter or a horizontal bath or shower surface or, in some cases, vertically by hanging the tray in the shower or on a wall. Some trays include storage for one or more spare shaving cartridges.

SUMMARY

Generally, the present invention relates to trays for shaving razors, shaving razor assemblies, spare shaving cartridges and containers for spare shaving cartridges. Shaving razor storage trays are disclosed herein that are configured to securely hold a shaving razor and spare shaving cartridges when not in use.

In one aspect, the invention features a tray for holding a razor, the tray comprising a main portion having an upper surface configured to support a portion of the razor, a retention feature configured to retain the razor securely on the main portion, and shaving cartridge magazine retention features extending below a lower surface of the main portion.

Some implementations of the invention may include one or more of the following features. The shaving cartridge magazine retention features may comprise a pair of opposed brackets extending from the lower surface of the main portion. The shaving cartridge magazine retention features may be configured to receive a generally box-shaped magazine. The brackets may comprise two inwardly facing L-shaped elements that define a space therebetween that is dimensioned to receive magazine. The inward facing surfaces of the L-shaped elements may include stop features configured to engage the sides of the magazine. The brackets may be designed to flex when a magazine is inserted between or removed from the brackets. The shaving cartridge magazine retention features may be configured so that the contents of the magazine may be accessed without removing the magazine.

In another aspect, the invention features a tray for holding a razor, the tray comprising a main portion configured to support a portion of the razor, and a retention feature configured to retain the razor securely on the main portion, the retention feature comprising an arcuate portion configured to be received within an open area of a distal end of a handle of the razor.

Some implementations of the invention may include one or more of the following features. The arcuate portion may flex during insertion into the open area, such that it may be pretensioned against a surface of the handle when the razor is in place in the tray.

The retention feature may further comprise a support portion adjacent the arcuate portion, the support portion being configured to support a surface of the handle. The arcuate portion may be configured with a curved surface that faces generally in the direction of the long axis of the tray. The razor may include a cartridge having a blade surface, and the retention feature may be configured to support the blade surface above an opposing surface of the main portion. The main portion may include a drain port. The drain port may be positioned to be under a cartridge end of the razor when the razor is in place in the tray. The main portion may include a lip configured to interact with a proximal end of the handle.

The invention also features methods of using the trays described herein to store and transport shaving razors.

DETAILED DESCRIPTION

The present disclosure relates generally to shaving razor trays that securely hold a shaving razor and extra shaving cartridges. Shaving razors commonly comprise a handle, an interface element, and a cartridge in which a plurality of blades are disposed generally perpendicular to the long axis of the handle. The components of such shaving razors are well known in the art. The trays disclosed herein are particularly useful for storing razors having a handle with a yoke that defines a central open area, e.g., as shown in FIG. 4, as will be discussed in further detail below.

Figure 1:
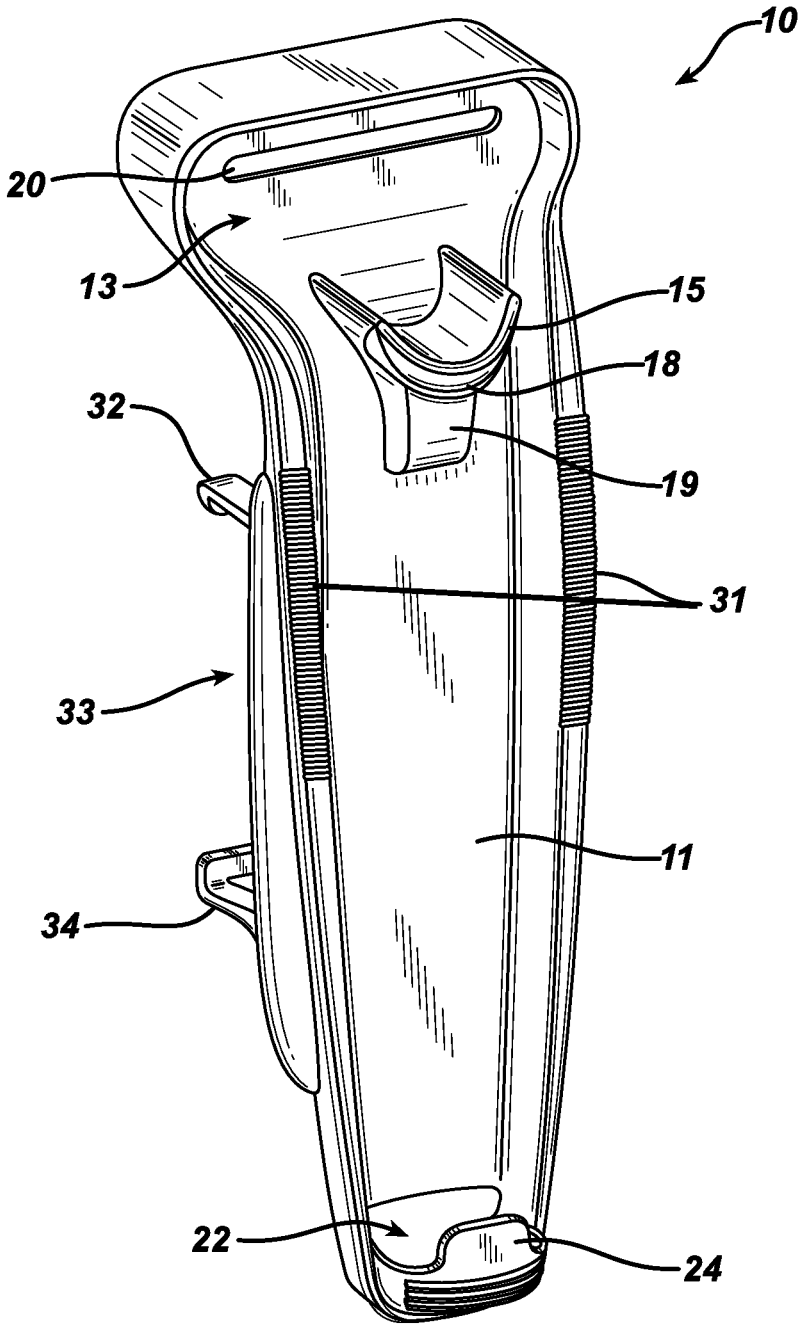
FIG. 1 is a top, perspective view of the tray.
Figure 2:
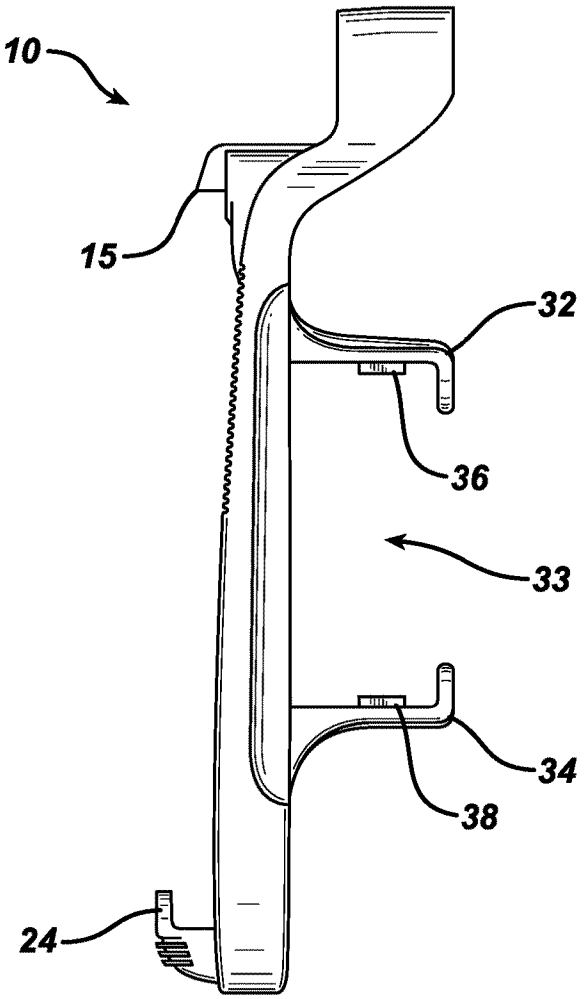
FIG. 2 is a right elevation view of the tray.

Referring to FIGS. 1 and 2, the tray 10 includes a base portion 11, a cartridge-receiving portion 13 disposed at one end of the base portion, and a retention element 15. The tray 10 is contoured to match the profile of the shaving assembly.

Figure 4:
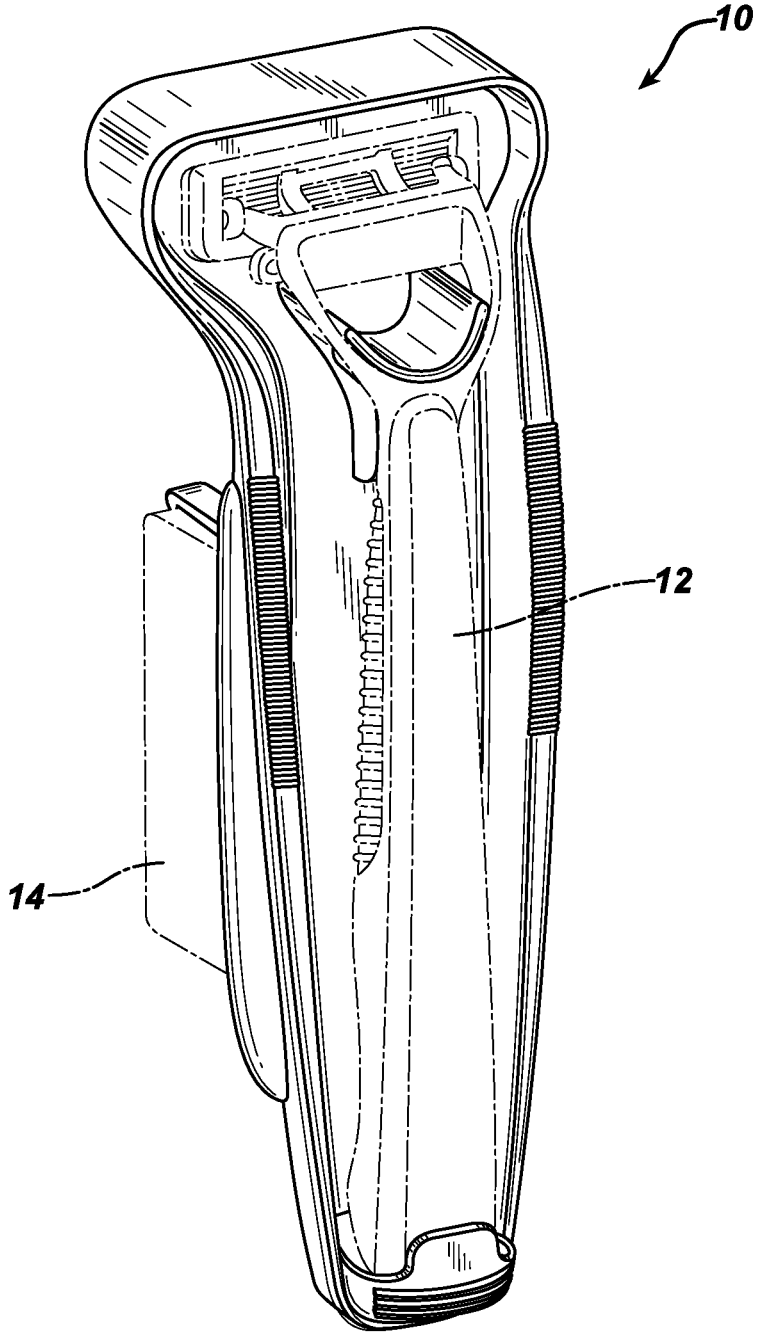
FIG. 4 is a top, perspective view of the tray with a shaving razor and shaving cartridge storage device shown in phantom.
Figure 5:
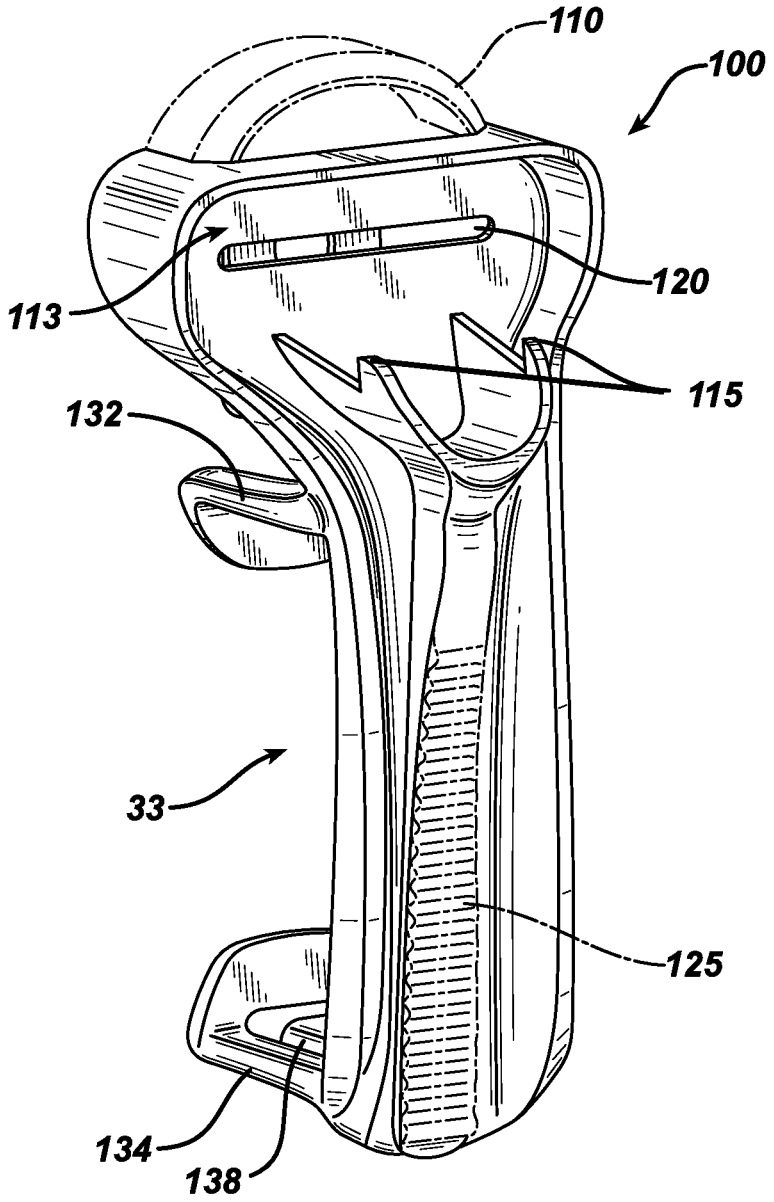
FIG. 5 is top, perspective view of an alternate embodiment of the tray, with a hanging hook shown in phantom.
Figure 7:
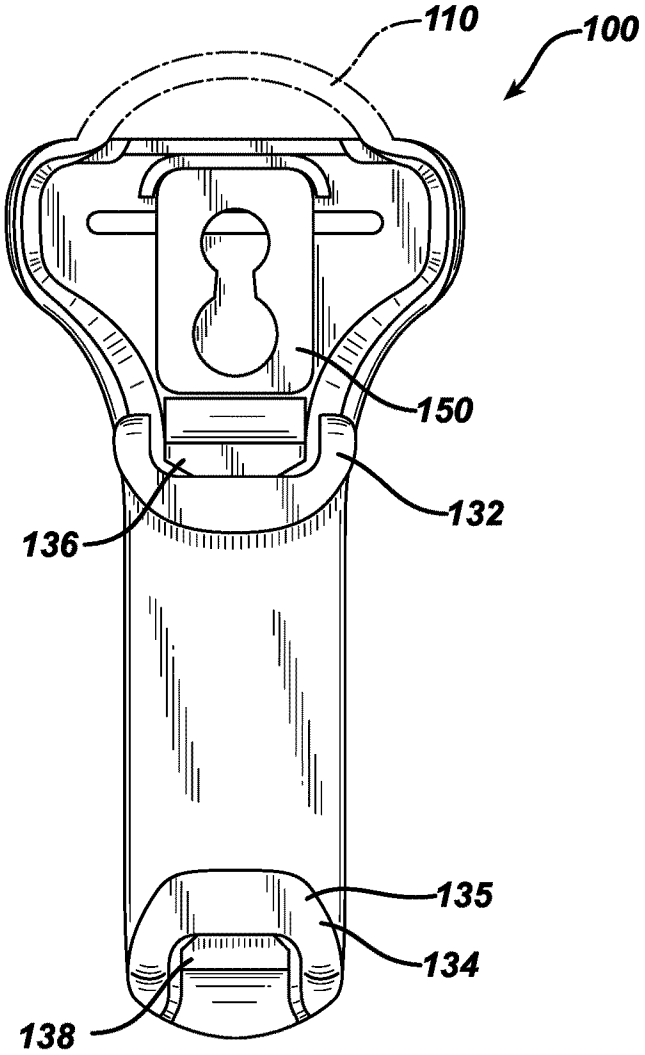
FIG. 7 is a bottom plan view of the tray shown in FIG. 5.
Figure 6:
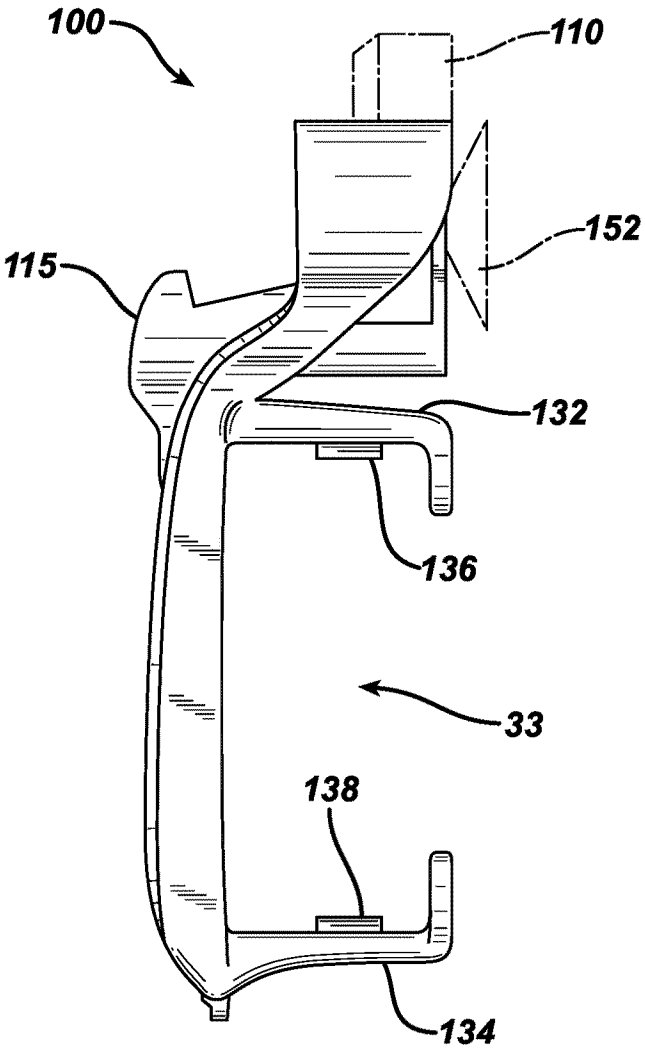
FIG. 6 is a right elevation view of the tray shown in FIG. 5, with a hanging hook and suction cup shown in phantom.

The retention element 15 is disposed near cartridge-receiving portion 13 and is configured to interact with a portion of a razor (as seen in FIG. 4). The retention element 15 extends generally perpendicularly to the surface of the base portion 11, and includes an arcuate portion 18 that extends a first distance above the surface of the base portion, and a supporting portion 19 that extends a second, lesser distance above the surface. Preferably, the arcuate portion 18 is relatively thin-walled, allowing it to flex slightly, and the supporting portion is solid, as shown. The curved surface of the arcuate portion faces generally in the direction of the long axis of the tray and toward the cartridge-receiving portion 13.

Referring to FIG. 1, lip element 24 is disposed at the opposite end of the base portion from the cartridge-receiving portion. Lip element 24 aids the retention element 15 in securing the shaving assembly to the tray, as seen in FIG. 4, because a portion of the handle bears upon the underside of the lip. Aperture 22 is configured directly below the lip portion on the base portion of the tray. Aperture 22 allows the distal end of the razor handle to rotate downward when disengaging the shaving assembly from the tray. Ribbed areas 31 are configured to serve as both tray tactile elements that help the user to hold the tray during removal and insertion of the razor from the tray and as aesthetic features.

To engage the razor to the tray, the user aligns the shaving razor with the tray. The distal end of the handle is inserted into aperture 22. Then the cartridge-end of the razor is rotated downward until the retention element 15 is encountered. The retention element is dimensioned so that the arcuate portion 18 is received into an open portion of the yoke of the handle. The support portion 19 is positioned under the base of the yoke, supporting the yoke as well as the arcuate portion 18. In some implementations, in which the arcuate portion 18 is slightly flexible, a retention force must be exceeded to slightly distort the retention element sufficiently for it to be received in the opening. Once the handle reaches the capture position, the retention element returns to its pre-tensioned orientation and, together with lip 24, securely holds the handle and thereby the razor in a predetermined orientation.

When the razor handle is engaged in the tray, the contoured shape of the tray in combination with the retention element and lip securely holds the razor, preventing movement of the cartridge relative to the tray, and suspends the cartridge slightly above the floor of cartridge-receiving portion 13. This positioning of the razor in the tray helps to protect the razor cartridge, e.g., the blade edges, from damage during movement of the tray such as during travel.

To disengage the razor shaving assembly from the tray, the user simply grasps the handle of the razor in one hand and a portion of the tray in the other and applies the necessary force to distort the retention element until the shaving razor assembly is released from the capture position. Then the user lifts the handle out and away from the tray. In some implementations, the retention element is not flexible, and the user need only tip the cartridge end of the razor up, removing the arcuate portion from the yoke opening and allowing the opposite end of the handle to be disengaged from the lip 24. In such implementations the user can typically remove the razor from the tray with one hand.

As shown in FIG. 4, the cartridge-receiving portion 13 is dimensioned to substantially surround a portion of the razor cartridge, thereby effectively protecting the blades from unwanted contact or contamination when not in use, for example during storage or transport. A drain port 20 is disposed on the bottom aspect of the cartridge-receiving portion 13 so that excess water can easily drain away from the cartridge.

Figure 3:
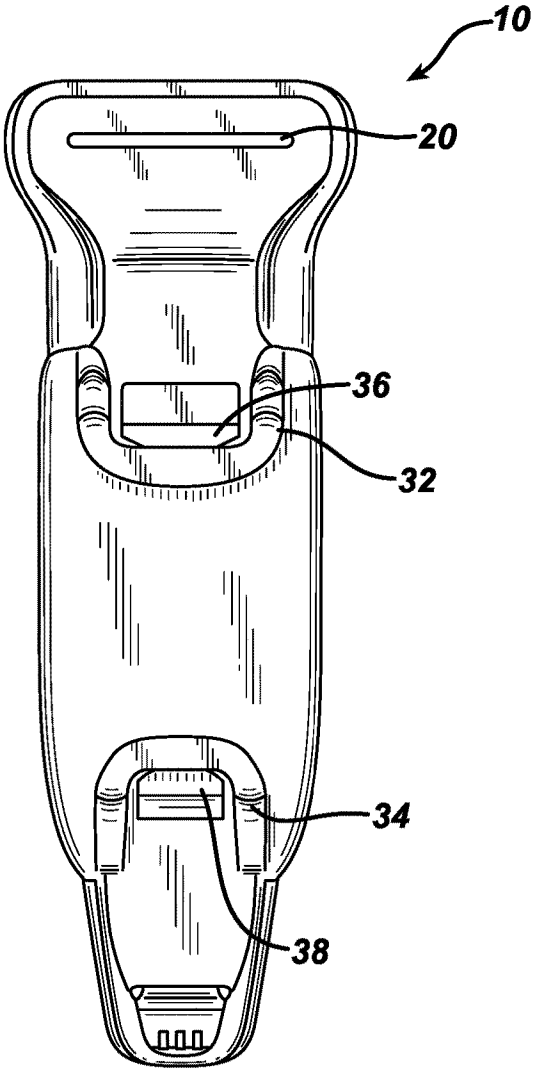
FIG. 3 is a bottom plan view of the tray.

Referring to FIGS. 2, 3 and 4, a shaving cartridge magazine holder 30 is disposed on the underside of base portion 11 and comprises bracket elements 32, 34. Bracket elements 32, 34 consist of two inward facing L-shaped elements, that together define a space 33 that is dimensioned to receive a shaving cartridge magazine 14, as seen in FIG. 4. Stop features 36, 38 are configured to engage the sides of the shaving cartridge magazine 14 thereby reliably securing the magazine in the holder. Bracket elements 32, 34 are designed to slightly flex when an appropriate force is applied, thereby releasing the magazine. This allows the user to swap a used or empty magazine with a new, full magazine thereby extending the useful life of the tray. The magazine holder 30 is designed so that contents of the magazine may be accessed while the magazine is securely held by bracket elements 32, 34, enabling the user to exchange or store a shaving cartridge without removing the magazine from the tray. In some cases, the magazine holder 30 is configured to receive a cartridge magazine of the type described in U.S. application Ser. No. 14/101,163, filed Dec. 9, 2013, the full disclosure of which is incorporated herein by reference. In such cases, the magazine includes a sliding inner drawer, and the bracket elements are configured to allow the drawer to be moved between its various positions without removing the magazine from the bracket elements or picking up the tray.

Referring to FIG. 2, the base portion 11 is shaped so that the bracket elements 32, 34 are at substantially the same vertical distance from the upper surface of the base portion 11 as the lower surface of the cartridge-receiving end of the base portion 11, so that when the tray is placed on a horizontal surface it will lay flat and in a stable position.

Figure 8:
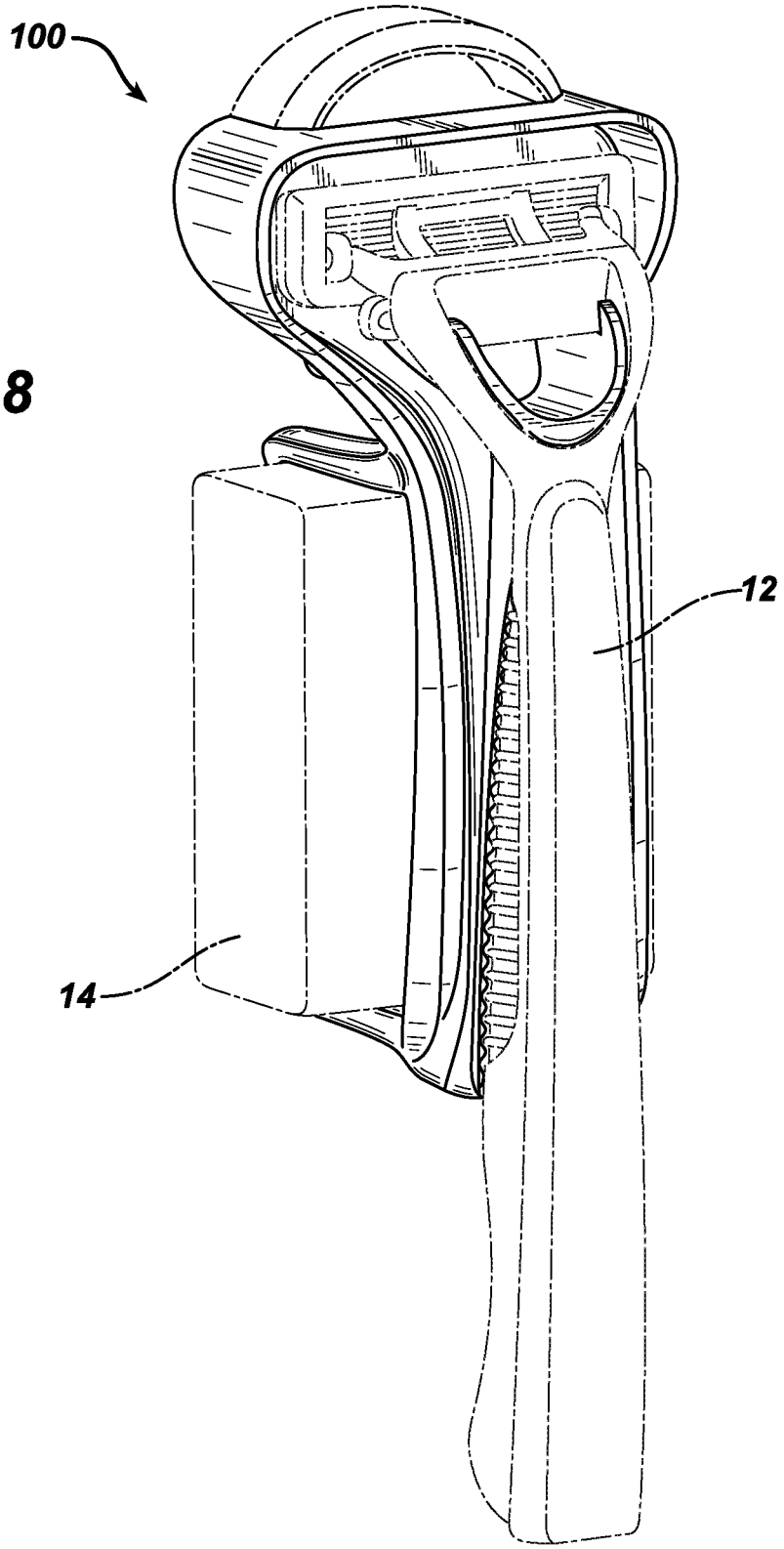
FIG. 8 is a top, perspective view of the tray shown in FIG. 5, shown with a shaving razor and shaving cartridge storage device shown in phantom.

Referring to FIGS. 5-8, an alternate embodiment of the tray 110 features all of the same elements of the tray previous described, with a few differences. For example, base portion 111 is slightly shorter than base portion 11 previously described, extending only about half the length of the handle of the razor 12 (FIG. 8), and does not include lip 24. These features allow the user to easily remove the razor 12 from the tray when the tray is hanging from a vertical surface. Corrugated features 125 are configured to interact with the underside of the razor handle, as seen in FIG. 8. Retaining feature 115 includes a notched upper edge that is configured to interact with the yoke of the razor to eliminate accidental disengagement when the tray is hanging from a vertical surface.

The embodiment shown in FIGS. 5-8 also includes features to allow the tray to be mounted vertically. Suction cup mount 150 is disposed on the underside of the base element directly opposite to the cartridge portion 113. The suction cup mount allows the user to apply a suction cup to the tray and thereby attach the tray to a smooth surface, such as a mirror, the wall of a shower stall or similar. Loop element 110 is disposed on the upper edge of the cartridge portion of the tray, allowing the user to hang the tray from a protrusion, e.g. a hook.

Referring to FIGS. 5-8, bracket elements 132, 134 and stop features 136, 138 are configured to securely hold a cartridge magazine 14 in the same manner that was previously disclosed.

The tray can be made of any suitable material including, for example, polyethylene terephthalate (PET or PETE), high density (HD) PETE, thermoplastic polymer, polypropylene, oriented polypropylene, polyurethane, polystyrene, acrylonitrile butadiene styrene (ABS), polyvinyl chloride (PVC), polytetrafluoroethylene (PTFE), polyester, metal, synthetic rubber, natural rubber, silicone, nylon, polymer, wood, antibacterial or antimicrobial materials, insulating, thermal, other suitable sustainable or biodegradable materials, or any combination thereof.

Other Embodiments

A number of embodiments have been described. Nevertheless, it will be understood that various modifications may be made without departing from the spirit and scope of the disclosure.

Accordingly, other embodiments are within the scope of the following claims.

What is claimed is:

1. A tray for holding a razor, the tray comprising:

a main portion having an upper surface configured to support a portion of the razor, a retention feature configured to retain the razor securely on the main portion, and shaving cartridge magazine retention features extending below a lower surface of the main portion, the retention features comprising a pair of opposed brackets extending from the lower surface of the main portion, each of the brackets including an inward facing side wall and a raised stop feature configured to engage a side wall of a shaving cartridge magazine and maintain the side wall of the shaving cartridge magazine in spaced relation with the inward facing side wall of the bracket.

2. The tray of claim 1, wherein the shaving cartridge magazine retention features are configured to receive a generally box-shaped magazine.

3. The tray of claim 2, wherein the brackets comprise two inwardly facing L-shaped elements that define a space therebetween that is dimensioned to receive the magazine.

4. The tray of claim 1, wherein the brackets are designed to flex when a magazine is inserted between or removed from the brackets.

5. The tray of claim 1, wherein the shaving cartridge magazine retention features are configured so that the contents of the magazine may be accessed without removing the magazine.

6. A tray for holding a razor, the tray comprising:

a main portion having an upper surface configured to support a portion of the razor, a retention feature configured to retain the razor securely on the main portion, shaving cartridge magazine retention features extending below a lower surface of the main portion, and a shaving cartridge magazine comprising an outer box and within the box a sliding inner drawer configured to slide in and out of the outer box.

7. The tray of claim 6 wherein the retention features comprise a pair of opposed brackets extending from the lower surface of the main portion, each of the brackets including an inward facing side wall and a raised stop feature configured to engage a side wall of the shaving cartridge magazine and maintain the side wall of the shaving cartridge magazine in spaced relation with the inward facing side wall of the bracket.

8. The tray of claim 7 wherein each of the stop features comprises a planar bearing surface that is in contact with the side wall of the shaving cartridge magazine.

9. The tray of claim 8 wherein the stop features comprise generally cylindrical bosses.

10. The tray of claim 6 wherein the retention features comprise generally L-shaped brackets that are configured to allow a user to slide the drawer in and out of the outer box without removing the magazine from the brackets.

* * * * *